United States Patent [19]

Martin

[11] Patent Number: 4,733,648

[45] Date of Patent: Mar. 29, 1988

[54] COMPOUND BOW CABLE ANCHOR

[75] Inventor: Dan J. Martin, Walla Walla, Wash.

[73] Assignee: Martin Archery, Walla Walla, Wash.

[21] Appl. No.: 907,787

[22] Filed: Sep. 16, 1986

[51] Int. Cl.[4] ..... F41B 5/00

[52] U.S. Cl. ..... 124/86; 124/DIG. 1; 24/135 N

[58] Field of Search ..... 124/23 R, 24 R, 90, 124/DIG. 1; 24/135 N

[56] References Cited

U.S. PATENT DOCUMENTS

| | | | |
|---|---|---|---|
| 527,361 | 7/1850 | Schoenborn | 24/135 N |
| 1,882,167 | 10/1932 | Thirlwell | 24/135 N |
| 3,595,213 | 7/1971 | Storer | 124/23 R |
| 4,064,862 | 12/1977 | Groner | 124/23 R |
| 4,192,280 | 3/1980 | Rickard | 124/23 R |
| 4,300,521 | 11/1981 | Schmitt | 124/23 R |
| 4,333,443 | 6/1982 | Roelle | 124/24 R |
| 4,336,786 | 6/1982 | Mannon et al. | 124/23 R |
| 4,337,749 | 7/1982 | Barna | 124/29 R |
| 4,372,285 | 2/1983 | Simonds et al. | 124/90 |
| 4,440,142 | 4/1984 | Simonds | 124/23 R |
| 4,448,183 | 5/1984 | Quartino et al. | 124/24 R |
| 4,524,750 | 6/1985 | Darlington | 124/23 R |
| 4,546,754 | 10/1985 | Smith | 124/86 |

*Primary Examiner*—Richard C. Pinkham
*Assistant Examiner*—Benjamin Layno
*Attorney, Agent, or Firm*—Wells, St. John & Roberts

[57] ABSTRACT

An anchor for a compound archery bow includes a yoke portion formed at one end thereof and a reusable clamp formed at the opposite end. The anchor provides a way of securing the inside cables of a compound bow to the tips of the bow limbs adjustably and releasably.

20 Claims, 8 Drawing Figures

COMPOUND BOW CABLE ANCHOR

TECHNICAL FIELD

The invention relates generally to compound archery bows and more particularly to anchors for the inside cables of compound archery bows.

BACKGROUND OF THE INVENTION

Compound archery bows have become increasingly popular for hunting in recent years. These bows use a cable which extends over eccentric pulleys revolvably mounted at the tips of the bow limbs to provide a mechanical advantage during the draw back of a bowstring.

The compound bow cable includes a central, or bowstring, portion for reception of the arrow and also a pair of inside cable portions which extend over the pulleys. The inside cable portions typically cross one another between the limbs and attach to the bow limb opposite the pulley over which the respective inside portion extends. With this arrangement, when the bow string is in the full draw position, maximum potential energy is stored in the bow while the force required to maintain the bow string in the full draw position is less than the maximum draw weight of the bow. In short, as the bowstring is being drawn, the draw weight or force applied to the bow increases to a maximum draw weight and reduces to a lower draw weight at the full draw position. Accordingly, maximum energy is stored in the limbs without requiring maximum force to be applied to the bowstring to hold it at the full draw position. This permits the archer to maintain aim on his target prior to release for a longer time for a better shot.

Many devices have been developed for attaching each inside cable portion to the respective opposite bow limb. One such method simply attaches the inside cable ends directly to the bow limb by a bolt. Other versions secure the inside cable to the bow limbs by means of a yoke member secured by a yoke cable to the axle upon which the respective eccentric pulley is rotatably mounted. Anchoring devices such as these are shown in U.S. Pat. Nos. 4,546,754 to Smith; 4,440,142 to Simonds; 4,337,749 to Barna; 4,333,443 to Roelle; 4,300,521 to Schmitt; and 4,064,862 to Groner.

For example, in each of the above noted patents to Schmitt, Smith and Simonds, a yoke cable connected at both its ends to a pulley axle extends about a perimetric edge portion of a yoke for securing the yoke anchor to the axle. An end of the inside cable extends through a hole or groove in the yoke anchor and is fixedly secured back to itself by a clasp or sleeve-like member. Such yoke anchors have the drawback of not permitting an inside cable to be readily removed from the anchor. Accordingly, a need remains for an inside cable anchor for a compound bow having the ability to releasably, reusably, and adjustably secure an inside cable to the bow limb.

BRIEF DESCRIPTION OF THE DRAWINGS

Preferred embodiments of the invention are illustrated in the accompanying drawings, in which.

DETAILED DESCRIPTION OF THE PREFERRED EMBODIMENT

The following disclosure of the invention is submitted in compliance with the constitutional purpose of the Patent Laws "to promote the progress of science and useful arts" (Article 1, Section 8).

The anchor of the present invention is designed for use with a compound archery bow of the type having one end of an inside cable attached to the tip of a bow limb by means of a double-ended yoke cable.

Figure 1:
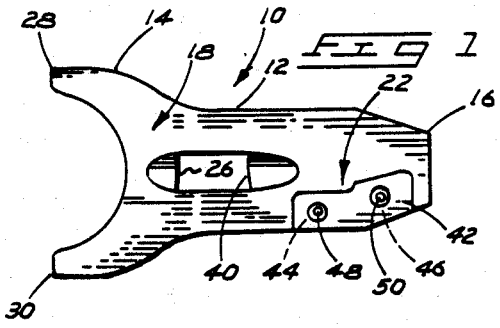
FIG. 1 is a top plan view of one embodiment of a yoke anchor in accordance with the invention.
Figure 2:
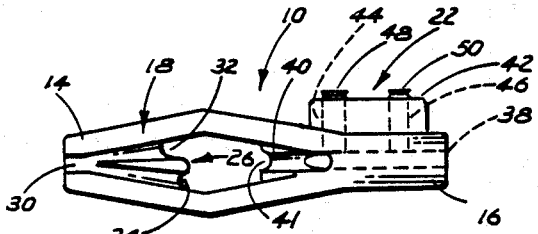
FIG. 2 is a side view of the yoke anchor shown in FIG. 1.
Figure 3:
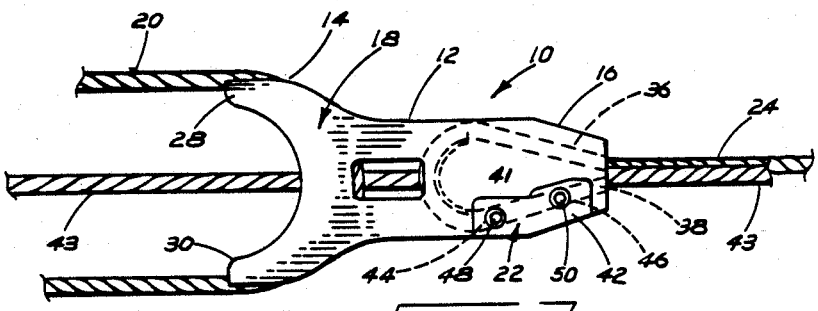
FIG. 3 is a top view of the yoke anchor of FIG. 1 shown operatively engaging a double ended yoke cable and inside cable of a compound bow.

Referring to FIGS. 1–3, a first embodiment of an anchor in accordance with the invention is indicated generally by numeral 10. Anchor 10 includes a body portion 12 having first and second opposed ends 14, 16, respectively. A yoke means 18 is formed across a first end 14 of body 10 for receiving an intermediate section of a yoke cable 20. A clamp means 22 is included at a second end 16 of body 12 for securing one end of an inside cable 24 to body 12. As shown, body 12 is a unitary member and can be formed of suitable plastic or other material.

The yoke means or yoke portion 18 of body 12 is semi-circular in shape having an arcuate perimetric edge portion 26 which extends across first end 18 and terminates at two diametrically opposed locations 28 and 30. A pair of grooves 32, 34 extends about perimetric edge portion 26 between the diametrically opposed locations 28 and 30 for defining cable receiving surfaces across which an intermediate section of yoke cable 20 is adapted to be received. Groove 32 is deeper than groove 34, providing a tension adjustment feature which will be more fully described below. Grooves 32, 34 converge with respect to one another to form a single groove at each of diametrically opposed locations 28 and 30.

Clamp means 22 at the second end 16 of body 12 is preferably reusable and integrally formed in the body. The clamp means includes a pair of passageways 36, 38 which extend into second end 16 of body 12 for receiving inside cable 24. Passageways 36, 38 diverge from one another towards a central open portion of body 12. Passageways 36, 38 are in substantially planar alignment with the grooved portion of yoke portion 18. More specifically, passageways 36, 38 are in substantially planar alignment with the two diametrically opposed locations 28 and 30 of grooves 32, 34 in the yoke portion 18. This substantial planar alignment serves to keep yoke cable 20 and inside cable 24 in the same plane. They accordingly occupy a minimum amount of space between the bow limbs.

An arcuate surface 40, integrally formed in body 12 and having a grooved 41 formed therein, extends across the central open portion of body 12 between internal end openings of passageways 36, 38. An intermediate portion of inside cable 24 is adapted to be received across surface 40 and within groove 41.

Clamping means 22 further comprises an upwardly projecting portion 42 at the second end 16 of body 12. Portion 42 is formed above passageway 38 but could just as well be formed above passageway 36. A pair of threaded holes 44, 46 extends from the exterior of body 12 through portion 42 to passageway 38. A pair of threaded elements 48, 50 are received in the respective threaded holes 44, 46 for clamping engagement against an inside cable 24 while received in the passageways and engaged by arcuate surface 40 and groove 41. Threaded elements 48, 50 are shown as small set screws movable between clamping and unclamping positions by being rotated in or out of threaded holes 44, 46, respectively. The clamping means thereby provides a way for releasably and adjustably securing one end of an inside cable to the anchor body.

Figure 5:
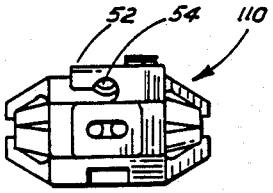
FIG. 5 is an end view of the yoke anchor shown in FIG. 4.
Figure 6:
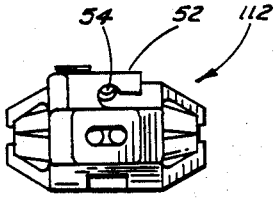
FIG. 6 is an end view of a mirror-image version of the yoke anchor shown in FIGS. 4 and 5.
Figure 4:
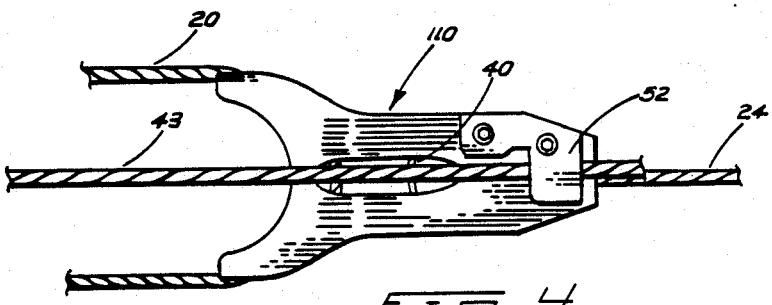
FIG. 4 is a top view of a second embodiment of a yoke anchor shown operatively engaging a double ended yoke cable and two inside cables of a compound archery bow.

Referring to FIGS. 4–6, a second embodiment of an anchor 10 in accordance with the invention is illustrated which includes means for slidably receiving a second of two inside cables. In certain smaller bows having smaller pulleys, it is desirable that the anchor and inside cables be pulled away from the bow string to minimize slapping of the bow string against the anchor and inside cables. To achieve this separation of the bowstring from the inside cables and anchor, the anchor of the present invention may be provided with a means for slidably receiving a second of two inside cables. The embodiment including such second cable receiving means is similar to the first embodiment such that only the differences will be highlighted.

The means for slidably receiving a second inside cable is comprised of a clip portion 52 which extends outwardly from body 12 for receiving the second inside cable. As shown, clip portion 52 is integrally formed as part of projecting portion 42 at second end 16 of body 12. Clip portion 52 could also be a separate member attached to body 12. Clip portion 52 includes a central cable receiving groove 54 for slidably securing a second cables 32 to anchor 110. When so received, second cable 43 will cause anchor 110, and correspondingly first inside cable 24 secured thereto, to be pulled away from the bow string, miminizing slapping of the bow string against the anchor and inside cables during use.

For this construction there are provided two different configurations of the yoke anchor which are mirror images of one another. This accommodates for the mirrored configurations of the opposed bow limb tips. FIG. 6 shows an anchor 112 which is the mirror image of the anchor 110 shown in FIGS. 4 and 5. The desirablility for mirrored configurations will be more readily understood by the following discussion which proceeds with reference to FIGS. 7 and 8.

OPERATION

Figure 7:
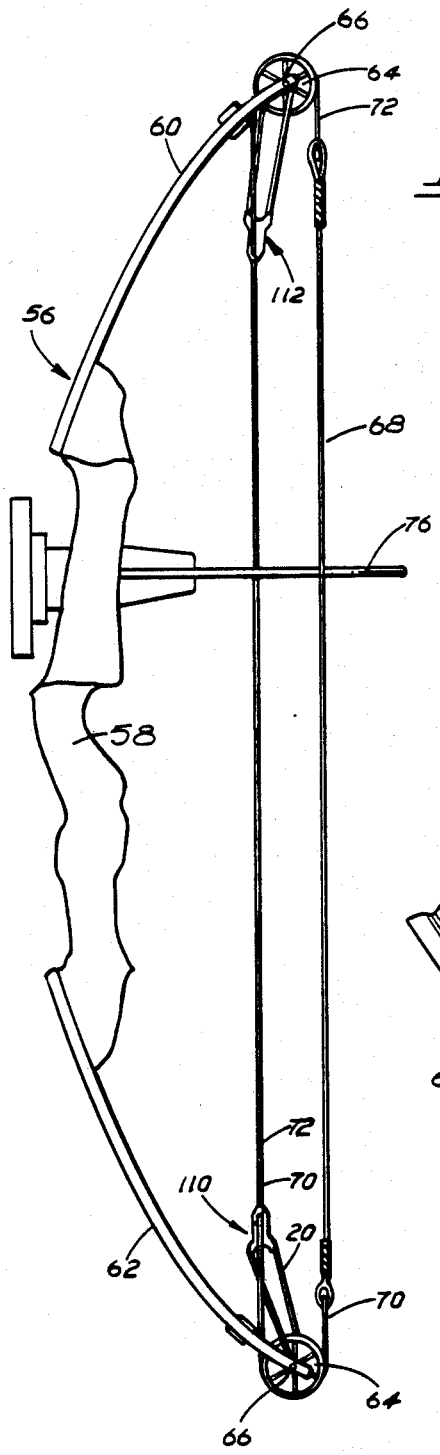
FIG. 7 is a side view of a compound archery bow operatively employing the yoke anchors of FIGS. 5 and 6.
Figure 8:
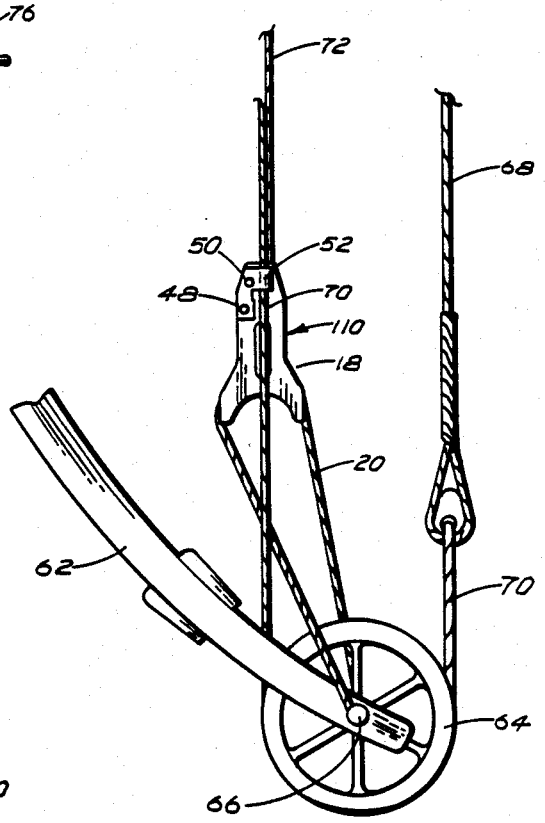
FIG. 8 is an enlarged view of the lower bow limb region of the compound archery bow of FIG. 7.

FIGS. 7 and 8 show a compound archery bow 56 operably employing the second embodiment of a yoke anchor in accordance with the invention. Compound bow 56 has a handle portion 58 and upper and lower extending bow limbs 60, 62, respectively. Pulleys, such as 64, are eccentrically mounted on axles 66 mounted across forked portions at the tips of the limbs 60, 62. Bow 56 includes a central cable portion, or bow string 68, secured at both ends to ends of a pair of inside cables 70, 72. Inside cables 70, 72 extend from ends of bow string 68 over respective eccentric pulleys 64 and are clamped to yoke anchors 112, 110, respectively. Bow 56 further includes a cable guard 76 which pulls inside cables 70, 72 slightly sideways away from bow string 68.

Referring to FIG. 8, anchor 110 is secured to lower bow limb 62 by means of a double ended yoke cable 20 secured at both of its ends to axle 66. (Anchor 112 is attached to the opposite upper bow limb 60 in the same manner.) Yoke cable 20 extends about the yoke portion 18 of anchor 110. An end of inside cable 72 is received in passageways 36, 38 and extends about surface 40, and is clamped within the passageways by inward threading of threaded elements 48, 50. Inside cable 70 is engaged by clip portion 52 thereby pulling anchor 110 and inside cable 72 away from bow string 68 to minimize interference or entangling during use.

It should be readily apparent that a mirror image anchor 112 of anchor 110 is employed for the top of the bow limb for positioning the anchor bodies to one side of the slidably received inside cables and thus positioning the anchor and cables furthest away from bow string 68. It should also be apparent that larger sizes of pulley 64 will increase the distance between bowstring 68 and the inside cables. Accordingly, for bows employing large diameter pulleys 64, clip portion 52 is not necessary to prevent interference of bow string 68 with the inside cables and anchor during use.

The degree of tension within cables 70, 72 and bow string 68 can be adjusted by the amount the ends of the inside cables are pulled through the passageways of the respective anchors and clamped therewithin. To increase tension, more cable is pulled through the passageways and fixedly clamped. Any excess extending from the anchor can be trimmed. Additionally, the different depths of grooves 32, 34 provide a way of adjusting the tension of the cables and bow string. By selecting which groove 32, 34 within which the respective yoke cables 20 are received, the tension of the cables and accordingly the bow string 68 can be varied. More than two grooves could also be provided giving a broader range of tension adjustment. Accordingly, the clamping means and double grooved yoke anchor provide two ways for adjusting the tension of the bowstring. Alternatively, only one groove could be provided in the yoke, the tension being adjustable solely by the cable clamping means.

As will be appreciated, the present invention provides a simple and inexpensive way of reusably and adjustably securing the inside cables of a compound bow to the bow limbs.

In compliance with the statute, the invention has been described in language more or less specific as to structural features. It is to be understood, however, that the invention is not limited to the specific features shown, since the means and construction herein disclosed comprise a preferred form of putting the invention into effect. The invention is, therefore, claimed in any of its forms or modifications within the proper scope of the appended claims, appropriately interpreted in accordance with the doctrine of equivalents.

I claim:

1. A compound bow cable anchor for a compound archery bow of the type having one end of an inside cable attached to a tip of a bow limb by means of a double ended yoke cable, the cable anchor comprising:

a body having a longitudinal dimension and a lateral dimension;

yoke means on the body for receiving an intermediate section of a yoke cable and for exerting tension in a longitudinal direction on said body; and clamp means on the body for attachment to one end of an inside cable, the clamp means comprising:

a surface across which an intermediate section of an inside cable is adapted to be engaged, at least a portion of the surface being substantially laterally oriented relative to the body and substantially perpendicularly oriented relative to said longitudinal dimension; and at least one clamping element movable relative to the body and inside cable between clamping and unclamping positions, the clamping element being located to engage a portion of an inside cable received by the anchor which is displaced from the lateral portion of the surface.

2. The anchor of claim 1 wherein the body is a unitary member and the clamp means is integrally formed in the body.

3. The anchor of claim 1 including passage means formed in the body leading from an external opening for receiving an inside cable;

at least one threaded hole in the body in communication with the passage means; and the clamping element being a threaded element which is received in the threaded hole for clamping engagement with an inside cable received in the passage means for releasably and adjustably securing one end of an inside cable to the body.

4. The anchor of claim 3 including two threaded holes in communication with the passage means, each threaded hole receiving a threaded element.

5. The anchor of claim 1 wherein the compound bow is of the type having first and second inside cables and a bow string, the clamp means being adapted to clamp one end of a first inside cable to the body, the body further including an outwardly extending clip portion for slidable engagement with an intermediate section of a second inside cable whereby, when a first inside cable is engaged by the clamp means and a second inside cable is engaged by the clip portion, the anchor and first inside cable are caused to be pulled away from a bow string to minimize slapping of a bow string against the anchor and inside cables.

6. The anchor of claim 5 wherein the clip portion extends outwardly from the body at a location adjacent to the clamp means.

7. A compound bow cable anchor for a compound archery bow of the type having one end of an inside cable attached to a tip of a bow limb by means of a double ended yoke cable, the inside cable extending tightly between the bow limbs along a defined line, the anchor comprising:

a body;

yoke means on the body for receiving an intermediate section of a yoke cable;

a pair of passageways formed in the body adapted to receive an inside cable;

a surface extending between an opening of one of the passageways and an opening of the other of the passageways across which an intermediate section of an inside cable is adapted to be engaged; and clamp means on the body for attachment to one end of an inside cable, the clamp means comprising:

means for clamping a movable element in at least one of the passageways for securing one end of an inside cable within at least one passageway.

8. The anchor of claim 7 wherein the clamp means comprises:

at least one threaded hole formed in the body, the hole being in communication with at least one of the passageways and a threaded element received in the threaded hole for clamping engagement with an inside cable received in at least one passageway.

9. The anchor of claim 7 wherein the yoke means has a groove which defines a cable receiving surface for receiving an intermediate section of a yoke cable, and wherein the groove and two passageways are in substantially planar alignment.

10. The achor of claim 9 wherein the yoke means is semi-circular in shape, having an arcuate perimetric edge portion terminating at two diametrically opposed locations, the groove extending about the arcuate perimetric edge portion between the two diametrically opposed locations, and the two diametrically opposed locations being in substantially planar alignment with the two passageways.

11. The anchor of claim 10 wherein the arcuate perimetric edge of the yoke means includes more than one groove, the grooves being of different depths and converging with respect to one another to form a single groove at each of the diametrically opposed locations.

12. A compound bow cable anchor for a compound archery bow of the type having one end of an inside cable attached to a tip of a bow limb by means of a double ended yoke cable, the anchor comprising:

a unitary body having a longitudinal dimension and a lateral dimension, and having a first and second opposed longitudinal ends;

a yoke portion formed across the first longitudinal end of the body, the yoke portion having a groove defining a first cable receiving surface across which an intermediate section of a yoke cable is adapted to be received and adapted for exerting tension in a longitudinal direction on said body; and reusable clamp means mounted to the second longitudinal end of the body for securing one end of an inside cable to the body, the reusable clamp means comprising:

a surface across which an intermediate section of an inside cable is adapted to be engaged, at least a portion of the surface being substantially laterally oriented relative to the body and substantially perpendicularly oriented relative to said longitudinal dimension; and at least one clamping element movable relative to the body and inside cable between clamping and unclamping positions, the clamping element being located to engage a portion of an inside cable received by the anchor which is displaced from the lateral portion of the surface.

13. The anchor of claim 12 wherein the reusable clamp means is integrally formed in the body.

14. The anchor of claim 12 wherein the compound bow is of the type having first and second inside cables and a bow string, the clamp means being adapted to clamp one end of a first inside cable to the body, the anchor further comprising an outwardly extending clip portion for slidable engagement with an intermediate section of a second inside cable whereby, when a first inside cable is engaged by the clamp means and a second inside cable is engaged by the clip portion, the anchor and first inside cable are caused to be pulled away from a bow string to minimize slapping of a bow string against the anchor and inside cables.

15. The apparatus of claim 14 wherein the clip portion is integrally formed in the body and extends outwardly from the body at a location adjacent to the reusable clamping means.

16. An anchor for a compound archery bow of the type having one end of an inside cable attached to a tip of a bow limb by means of a double ended yoke cable, the anchor comprising:

a unitary body having first and second opposed ends;

a yoke portion formed across the first end of the body, the yoke portion having a groove defining a first surface across which an intermediate section of a yoke cable is adapted to be received;

reusable clamp means integrally formed at the second end of the body for securing an end of an inside cable to the body, the clamp means comprising a pair of passageways extending into the second end of the body for receiving an inside cable, a second surface integrally formed in the body which extends between the passageways across which an intermediate portion of an inside cable is adapted to be engaged, at least one threaded hole extending from the exterior of the body to one of the passageways, and a threaded element received in the threaded hole for clamping engagement with an inside cable received in the passageways and engaged across the second surface of the body.

17. The anchor of claim 16 wherein the two passageways and the groove are in substantially planar alignment.

18. The anchor of claim 16 wherein the yoke portion is semi-circular in shape having an arcuate perimetric edge portion terminating at two diametrically opposed locations, the groove extending about the arcuate perimetric edge portion between the two diametrically opposed locations, and the two diametrically opposed locations being in substantially planar alignment with the two passageways.

19. The apparatus of claim 18 wherein the arcuate perimetric edge of the yoke portion includes more than one groove, the grooves being of different depths and converging with respect to one another to form a single groove at each of the diametrically opposed locations.

20. The anchor of claim 16 wherein the compound bow is of the type having first and second inside cables and a bow string, the clamping means being adapted to clamp one end of a first inside cable to the body, the anchor further comprising an outwardly extending clip portion for slidable engagement with an intermediate section of a second inside cable whereby, when a first inside is engaged by the clamp means and a second inside cable is engaged by the clip portion, the anchor and first inside cable are caused to be pulled away from a bow string to minimize slapping of a bow string against the anchor and inside cables.

* * * * *